United States Patent [19]

Suzuyama et al.

[11] Patent Number: 4,571,763

[45] Date of Patent: Feb. 25, 1986

[54] CUSHION MEMBER FOR A VEHICLE SEAT

[75] Inventors: Tomio Suzuyama; Akira Aoki, both of Akishima, Japan

[73] Assignee: Tachikawa Spring Co., Ltd., Japan

[21] Appl. No.: 626,044

[22] Filed: Jun. 29, 1984

[51] Int. Cl.[4] ..... A47C 27/14

[52] U.S. Cl. ..... 5/464; 5/481; 297/455; 297/DIG. 1

[58] Field of Search ..... 5/446, 447, 464, 481, 5/DIG. 2; 297/455, 458, DIG. 1

[56] References Cited

U.S. PATENT DOCUMENTS

| | | | |
|---|---|---|---|
| 1,742,186 | 1/1930 | Claus | 5/464 |
| 2,606,598 | 8/1952 | Smith | 297/DIG. 1 |
| 3,308,491 | 3/1967 | Spence | 297/458 |
| 3,612,607 | 10/1971 | Lohr | 297/DIG. 1 |
| 3,736,022 | 5/1973 | Radke | 297/DIG. 1 |
| 3,846,857 | 11/1974 | Weinstock | 5/447 |
| 3,987,507 | 10/1976 | Hall | 5/DIG. 2 |
| 4,190,697 | 2/1980 | Ahrens | 5/481 |

*Primary Examiner*—Kenneth J. Dorner
*Assistant Examiner*—Michael F. Trettel
*Attorney, Agent, or Firm*—Cushman, Darby & Cushman

[57] ABSTRACT

A cushion member for use in a vehicle seat is disclosed. In this cushion member, a block body formed of a soft foam material is embedded centrally of the bottom portion of a main body of the present cushion member which is formed of a harder foam material. The block body includes side walls that are not integrally connected to the main body, or separated from the main body by hardening/impregnation preventive means, while the upper wall of the block body oriented in a perpendicular direction relative to applied loads is welded integrally to the main body by means of a hardened/impregnated layer produced during formation of the main body. With the present cushion, therefore, loads applied to the cushion member are distributed over the entire block body, and at the same time the main body will not be deformed when the cushion member itself is deformed as the loads are applied thereto.

6 Claims, 5 Drawing Figures

CUSHION MEMBER FOR A VEHICLE SEAT

BACKGROUND OF THE INVENTION

1. Field of the Invention

The present invention relates to an improved cushion member for use in a vehicle seat which is formed of a foam material, such as polyurethane foam.

2. Description of the Prior Art

In most cases, a cushion member for a vehicle seat is conventionally formed of foam materials, such as polyurethane foam. Such foam materials not only exhibit excellent seat cushioning properties but are also well suited for mass production. It is also known, however, that such foam materials are still under improvement to cope with greater structural demands. That is, such foam materials are required to be capable of slightly hardening at the peripheries of the cushion member so as to eliminate deterioration of sitting comfort, while at the same time change its cushioning function in accordance with load distributions. Conventionally, in order to deal with these requirements, other separate materials are applied to the peripheral portions or desired locations of the cushion member, or alternatively a metal wire is embedded within the foam material.

These conventional means, however, cannot be said to have eliminated all drawbacks in the prior art foam cushion members. Specifically, the former means is accompanied by another disadvantage, that is, its step of applying separate members complicates the process of manufacturing such cushion member. In the latter case, another drawback arises; the foam material used is apt to run short in and from the vicinity of the embedded metal wire.

For this reason, there has been proposed another type of cushion member in the prior art which comprises a harder side element and a softer element embedded in the central portion of the side element. With this cushion member, the contact surfaces of both of the harder side and softer central elements are oriented in the same direction as that of loads to be applied. When such a cushion member is formed simply by inserting the softer central element into the harder side element is in actual use, the entire central portion thereof is softer than other portions thereof and thus only this central portion sinks in to perform a completely separate function from the harder side element. This means that a seat incorporating such cushion member therein is not able to provide a comfortable sitting feeling to its occupant.

On the other hand, in case of a cushion member which is manufactured by bonding the side and center elements together by adhesion, since their bonded surfaces are oriented in the same direction as that of loads to be applied, no effects on dispersion of the loads can be expected and thus the cushion member will be deformed or strained substantially when it is practically used. Therefore, a seat containing such cushion member cannot be a satisfactory one.

SUMMARY OF THE INVENTION

The present invention aims at elimination of the drawbacks found in the above-mentioned prior art cushion members.

Accordingly, it is a first object of the invention to provide an improved cushion member which is capable of dispersing loads effectively to produce a very comfortable sitting feeling when it is actually used.

In accomplishing this object, according to the invention, a face-like hardened/impregnated layer is provided in a direction perpendicular to a direction in which loads are applied so as to be able to disperse these loads effectively. A soft block body placed under the hardened/impregnated layer permits the loads to be dispersed over the entire block body itself, resulting in an excellent sitting touch.

It is a second object of the invention to provide a cushion member which itself will not be deformed and get out of shape.

To achieve this object, according to the invention, the side walls of the block body are arranged such that they are not integrally welded to the main body of the cushion member. Therefore, when loads are given to the block body, such loads will have no effects on the side portions of the cushion member so that the side portions of the cushion member will not be deformed.

It is a third object of this invention to provide a cushion member which can be easily manufactured at low costs.

In order to attain this object, according to the invention, a block body with a soft material such as a polyethylene film wound around its side walls is inserted within molds, and thereafter the main body of the cushion member is formed. Alternatively, after the block body is fitted into a frame provided in the internal walls of molds, the main body of the cushion member is foamed to form a complete cushion member.

These and other objects and advantages of the invention may be readily ascertained by referring to the following description and appended drawings.

BRIEF DECRIPTION OF THE DRAWINGS

DETAILED DESCRIPTION OF PREFERRED EMBODIMENTS OF THE INVENTION

Figure 1:
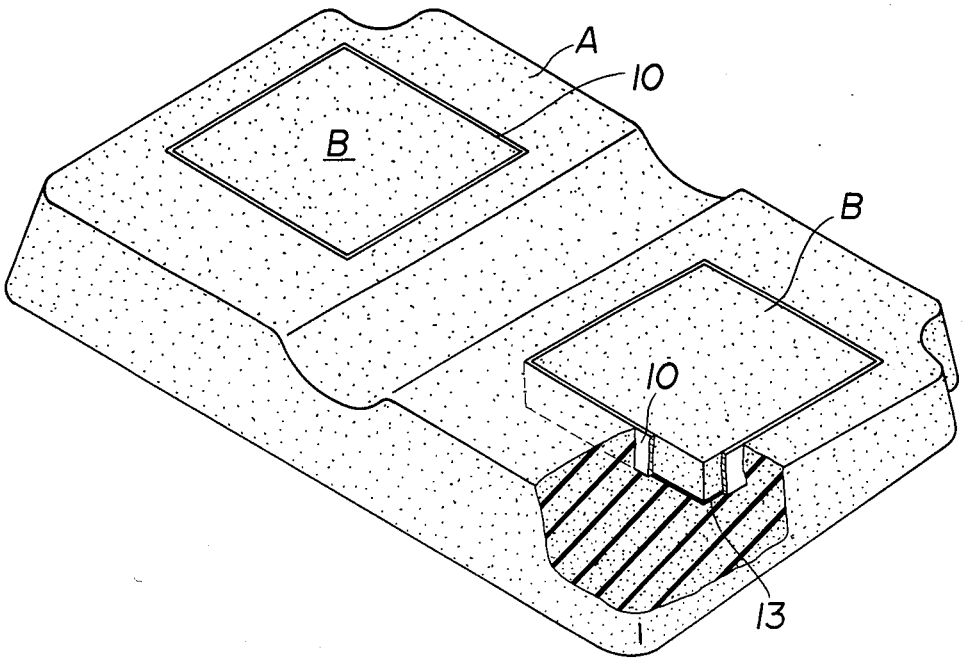
FIG. 1 is a partially cut-away bottom side perspective view of a cushion member constructed in accordance with the invention.

In FIG. 1, there is illustrated a cushion member for a vehicle seat constructed in accordance with the present invention as it is turned over for illustration. In the drawings, reference character (A) designates a main body of the present cushion member which is formed of slightly harder polyurethane foam. This main body (A) is covered on its outer surface with a top member, and is then placed onto and fixed to a saucer-like frame so as to form a vehicle seat. The polyurethane foam used for the main body (A) exhibits a hardness such that the main body (A) will not be deformed when it is hung into the above-mentioned frame by means of the top member.

Reference character (B) represents a block body that is embedded centrally of the bottom portion of the main body (A) and is formed of polyurethane foam softer than that of the main body such as a slab material. Although it is shown as a parallelepiped, this block body may be arbitrarily shaped in other forms such as a circular cylinder or a prism.

Numeral (10) designates a polyethylene film that is wound around the circumferential surfaces of the block bodies (B), (B). This polyethylene film (10) serves as a spacer between the block bodies (B), (B) and the main body (A) to prevent the block bodies (B) from being mutually integrally adhered to main body (A).

Numeral (13) denotes a hardened/impregnated layer which is provided in the form of a horizontal surface to cause the upper surfaces of the block bodies (B), (B) to adhere to the main body (A) in an integral manner.

Figure 2:
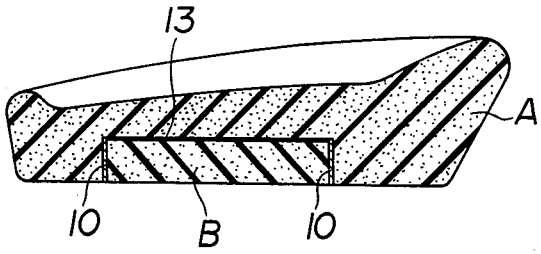
FIG. 2 is a longitudinal sectional view of the same cushion member.

FIG. 2 is a longitudinal section view of the cushion member of the invention wherein there is formed a recess internally of the central portion of the bottom of the main body (A) for mounting the block body (B) and this recess is provided with vertically-shaped internal walls and a horizontally-shaped ceiling. Therefore, the block body (B) to be mounted within the recess has a horizontally-shaped upper surface to be brought into contact with the ceiling of the main body (A). Thus, the main body (A) and the block body (B) can be intergrally welded together on their respective horizontal surfaces.

Figure 3:
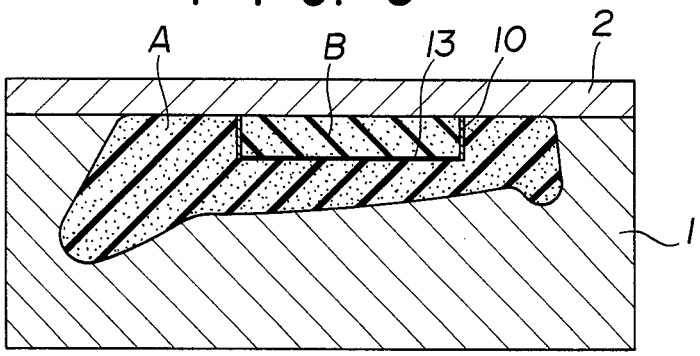
FIG. 3 is a longitudinal sectional view of the same cushion manner, illustrating how to manufacture the same.

FIG. 3 illustrates a method of welding the block body (3) to the main body (A). With the block body (B) fixed within molds (1), (2) for molding the main body (A), a foam material for forming the main body (A) is charged within these molds and then foamed to form the main body (A). During this operation, the solution of the foam material impregnates the portion of the block body (B) around which no polyethylene film (10) is wound (that is, horizontal surface), so that a hardened-impregnated layer (13) is formed thereat.

In the case of the cushion member that is formed by embedding the block member (B) within the bottom of the main body (A) described above, there is thus no possibility that the foam solution will impregnate into the side walls of the cushion member oriented in the same direction as that of loads applied to the block body (B) and therefore there is no possibility of the hardened-/impregnated layer being produced there. On the other hand, the hardened/impregnated layer (13) is formed on the upper surface of the block body (B). In other words, this cushion member is structured such that loads applied to the upper portion of the hardened/impregnated layer (13) are carried by the entire surface of the impregnated layer itself.

Figure 4:
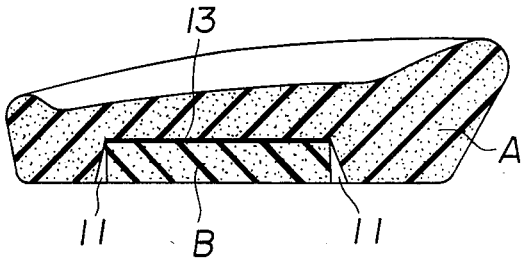
FIG. 4 is a longitudinal sectional view of another embodiment of the invention in which hardening/impregnation preventive means comprising vacant spaces is provided on the side walls of a block body; and, FIG. 5 is a longitudinal sectional view of still another embodiment of the invention in which such hardening/impregnation preventive means is provided on the side of the block body.
Figure 5:
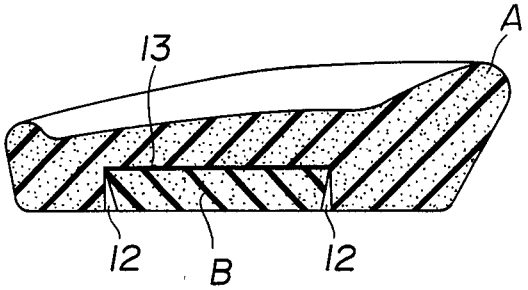

Now, in FIGS. 4 and 5, another embodiments of the invention are illustrated in which there are provided hardening/impregnation preventive means between the side walls of the block body (B) and the main body (A) respectively consisting of annular vacant spaces (11), (12) with their respective spacings gradually increasing in a downward direction. Specifically, the hardening-/impregnation preventive means (11) shwon in FIG. 4 are provided on the side of the main body (A), while the hardening/impregnation preventive means (12) in FIG. 5 are arranged on the side of the block body (B). These hardening/impregnation preventive means are formed in the following manner: after frame-like projections have been provided within the molds (1), (2), the block body (B) is inserted into these projections and is then foamed integrally with the main body (A).

As has been discussed hereinbefore, according to the invention, an improved cushion member is provided which permits applied loads to be distributed over the entire block body because of formation of a hardened-/impregnated layer oriented in a direction perpendicular to that of the applied loads, and also which is able to function properly in response to the application of the loads by means of elimination of the hardened/impregnated layer oriented in the same direction as that of the loads applied as in the prior art cushion members.

Also, according to the invention, since a block body that is formed of a softer foam material is embedded into the central portion of the bottom of the main body of the present cushion member, the main body itself can be formed of a slightly harder foam material that will not be deformed when it is hung in by a top member, so that a seat having a predetermined external shape can be provided in a simple manner.

Further, the cushion member of the present invention is quite easy to manufacture and thus it can be supplied at low costs.

What is claimed is:

1. A cushion member for a vehicle seat comprising:

a main body formed of a foamed material and defining an upper seat area upon which sitting loads are applied, said main body defining a recess subjacent to said seat area, said recess including a ceiling wall and dependently projecting peripheral walls;

a block body disposed in said recess and having an upper surface adjacent to and in contact with said ceiling wall, and side walls adjacent respective ones of said peripheral walls, said block body being formed of a softer foamed material than the foamed material of said main body;

bonding means for permanently bonding said upper surface and said ceiling wall one to another, said bonding means forming a hardened layer between said block body and said main body; and bonding-preventing means disposed between said side and peripheral walls for preventing bonding of said side and peripheral walls one to another, wherein said bonding means is disposed substantially perpendicular to said applied sitting loads for distributing same over said block body.

2. A cushion member as in claim 1 wherein said bonding-preventive means include a flexible synthetic resin film.

3. A cushion member as in claim 1 wherein said bonding-preventing means includes an annular space defined between said side and peripheral walls.

4. A cushion member as in claim 3 wherein said annular space is established by means of said side walls being downwardly divergent relative said peripheral walls.

5. A cushion member as in claim 3 wherein said annular space is established by means of said peripheral walls being downwardly divergent relative said side walls.

6. A cushion member as in claim 3 wherein said bonding means is a hardened layer established by said block body foamed material, in the vicinity of said upper surface thereof, being impregnated by a portion of the foamed material of said main body.

* * * * *